United States Patent [19]

Shewmake, Sr.

[11] Patent Number: 4,494,425

[45] Date of Patent: Jan. 22, 1985

[54] BACKUP TONG

[76] Inventor: Hollis G. Shewmake, Sr., 412 Pine, Levelland, Tex. 79336

[21] Appl. No.: 477,436

[22] Filed: Mar. 21, 1983

[51] Int. Cl.[3] ..... B25B 17/00

[52] U.S. Cl. ..... 81/57.34; 81/57.2

[58] Field of Search ..... 81/57.34, 57.35, 57.33, 81/57.2, 57.19, 57.16, 57.15

[56] References Cited

U.S. PATENT DOCUMENTS

| | | | |
|---|---|---|---|
| 1,198,365 | 9/1916 | Manney | 269/156 |
| 3,025,733 | 3/1962 | Soodnizin | 81/57.16 |
| 3,799,009 | 3/1974 | Guier | 81/57.34 |
| 4,372,026 | 2/1983 | Mosing | 81/57.2 |

FOREIGN PATENT DOCUMENTS

| | | | |
|---|---|---|---|
| 2426540 | 1/1980 | France | 269/156 |

*Primary Examiner*—James L. Jones, Jr.
*Attorney, Agent, or Firm*—Wendell Coffee

[57] ABSTRACT

A backup tong incorporates a self-tightening feature to securely hold a string of tubing stationary while a spinning tong rotates a joint of tubing. The string of tubing is aligned between a moveable jaw and a body jaw of the backup tong. The moveable jaw is journaled for movement about a cam axis that is parallel to the tubing wall. The cam axis is eccentric to a curved face of the moveable jaw so that as the moveable jaw is moved the distance between the jaws changes. Prior to operations of the spinning tong, an air cylinder moves the moveable jaw into contact with the tubing. Rotation is begun and the induced movement of the tubing wall adjacent the moveable jaw toward a backer adjacent the jaws also moves the moveable jaw face toward the backer, thereby tightening the grip of the jaws on the tubing until the tubing is held stationary. A bracket attached to the spinning tongs has a slot therein parallel to the tubing. A post on the backup tong slidably positioned within the slot permits automatic adjustment of the distance between the spinning tong and the backup tong during threading and unthreading and orientation of the backup tong during alignment of the tubing between the jaws.

7 Claims, 9 Drawing Figures

BACKUP TONG

BACKGROUND OF THE INVENTION (1) Field of the Invention

This invention relates to tongs for gripping and holding cylindrical goods.

(2) Description of the Prior Art

Tubing and rods used in the bore of wells are comprised of many lengths or joints threaded or connected together to form a string. Equipment for threading and unthreading such lengths, or making up or breaking down the string, ordinarly includes a holder or tong for holding the string within the bore stationary while a spinning holder or tong rotates a length or joint of tubing in threadable alignment with the string. Such makeup or breakdown operations ordinarily involve large forces and heavy equipment.

Some holders or tongs in common use are manually locked and operated. On occasion, the person holding or operating the holder is injured because of his proximity to the makeup or breakdown operations and equipment when something slips or breaks.

Before this application was filed, a search was made in the U.S. Patent and Trademark Office. That search developed the following U.S. Pat. Nos.

| | |
|---|---|
| PAGENT | 2,760,392 |
| HAM ET AL | 3,518,903 |
| BARRON ET AL | 3,780,815 |
| GUIER | 3,799,009 |
| ECKEL | 4,082,017 |
| KINZBACH | 4,346,629 |

These patents are considered pertinent because the applicant believes the Examiner would consider anything revealed by the search to be relevant and pertinent to the examination of this application.

SUMMARY OF THE INVENTION (1) New Function and Surprising Results

I have invented a backup tong that solves many of the problems associated with prior art tongs and that does not require substantial amounts of power to operate. Additionally, my invention accomplishes the unusual and surprising results of automatic self-tightening action responsive to undesired rotation of the tubing and utilization of the torque exerted on the tubing during the spinning operations to grip and hold the tubing with my novel combination of air cylinders, pins, bolts, toothed faces, jaws, and posts.

Prior to my invention, other workers in the art had devised various manually controlled and operated tongs and powered tongs as described above. The common feature of these prior art tongs is that the tubing is held stationary by the exertion of force on the moveable jaws to bear the gripping surfaces thereof against the cylindrical walls of the tubing. The gripping or holding ability of the prior art was related to the power exerted on the jaws by a source other than the rotation or movement of the tubing being held. However, my invention employs the rotational power or torque exerted on the tubing by the spinning tong to increase gripping action by tightening the jaws on the tubing as it rotates. The gripping action is also self-regulating in that the jaws are tightened only to that extent necessary to hold the tubing stationary. If during threading or unthreading operations, the tubing starts to move, the jaws will automatically tighten to increase the gripping action on the tubing and to hold it stationary.

My invention includes a moveable jaw that is journaled to a backup tong body for movement about a cam axis. A fixed or body jaw opposite the moveable jaw is rigidly attached to the body. A backer on the body is adjacent to the two jaws with the backer and the jaws forming a U-shaped mouth. The jaws have gripping faces thereon. Tubing or rods are aligned between the jaws with the wall of the tubing or rod parallel to the cam axis.

The cam axis is eccentric to the gripping face of the moveable jaw such that the distance between the moveable jaw and the fixed or body jaw changes as the moveable jaw is moved about the cam axis.

In operation, the backup tong is oriented and the tubing or rod is aligned within the mouth such that the cylindrical wall adjacent the moveable jaw will move toward the backer responsive to rotational movement anticipated during threading or unthreading operations. During such alignment and orientation, the moveable jaw is withdrawn well away from the backer for easy loading of the tubing into the mouth. Prior to initiation of the make up or breakdown operations, the moveable jaw is moved or rotated about the cam axis toward the backer until it is contacted with the cylindrical wall. This contact will ordinarily bring the cylindrical wall into contact with the backer and the fixed or body jaw face. I prefer to employ an air cylinder or other powered means to engage the moveable jaw with the tubing or rod. These lever means for moving the moveable jaw into contact with the tubing may be remotely operated and are therefore safer and more efficient because workers are not required to come in close proximity to the operations. However, the engagement of the moveable jaw with the tubing does not require substantial power or force, and could be performed manually, if desired. It is important to note that after the moveable jaw is engaged with the tubing, no further amounts of power are required for the tightening and gripping actions of my invention.

After the moveable jaw is contacted with the tubing, make up or breakdown operations begin with operation of the spinning tong to threadably engage the joint of tubing with the string. The rotation of the joint of tubing will cause the string of tubing to rotate and move the cylindrical wall adjacent the moveable jaw toward the backer. As described above, the movement of the cylindrical wall moves, the moveable jaw toward the back face, thereby decreasing the distance between the jaws and pressing the jaws more tightly against the tubing. The moveable jaw will continue to tighten against the tubing until movement of the string of tubing stops.

My invention also automatically adjusts the distance between the spinning tong and the backup tong during threading and unthreading operations. The backup tong of my invention is slidably mounted to a bracket attached to the spinning tong. The slidable mounting permits movement of the backup tong along a line parallel to the tubing. Therefore, during threading operations, as the joints are threaded together, the distance between the tongs decreases. The converse is true for unthreading operations.

Thus the function of the total combination far exceeds the sum of the functions of the individual elements, such as brackets, plates, pivot pins, toothed faces, etc.

(2) Objects of This Invention

An object of this invention is to grip, hold, thread and unthread cylindrical goods.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENTS

Figure 1:
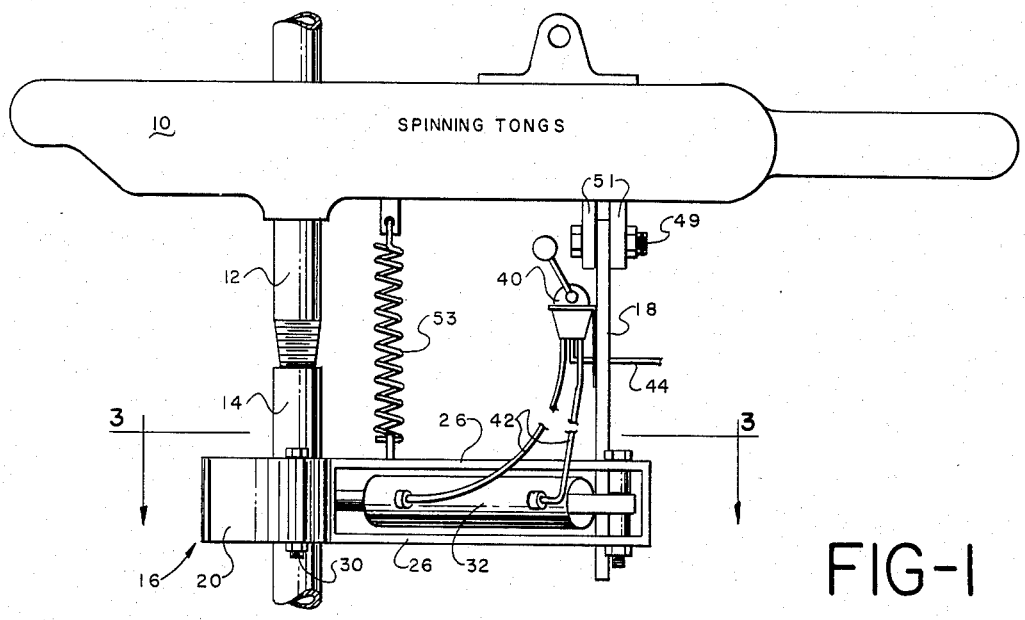
FIG. 1 is a side elevational view of backup tongs according to my invention connected to exemplary spinning power tongs of the prior art.

FIG. 1 shows a tong assembly used in connection with the assembly and disassembly, also referred to as make up and breakdown, of tubing or rods extending down into a well bore. The tong assembly includes spinning means in the form of spinning power tong 10 for rotating length of tubing 12 in threadable alignment with string of tubing 14, held stationary by backup tongs 16. The backup tongs 16 is connected to the spinning tongs 10 by bracket 18.

As used herein, cylindrical goods are elongated stems with circular cross-section. When used with wells, the cylindrical goods are assembled by threading or twisting the ends of lengths of cylindrical goods together. Although the definition of cylindrical goods is not limited hereby, some examples of cylindrical goods are hollow tubing or solid sucker rods or stems with threaded ends, as commonly used in the well drilling and servicing art.

Spinning tongs are defined as means for rotating a length or joint of tubing in threadable alignment with a string of tubing so as to thread or make up, the length into the string of tubing, or to unthread, or breakdown the length from the string of tubing. Although not restrictive of the definition of spinning means, some examples of such spinning tongs are the spinning power tong 10 shown in FIG. 1, wherein moveable jaws are pressed against the joint of tubing and rotated in a desired direction; or a wrench or other manually operated lever applied to induce a rotation of the joint of tubing, or a chain wrapped around the joint of tubing and forcefully pulled to rotate it.

Figure 5:
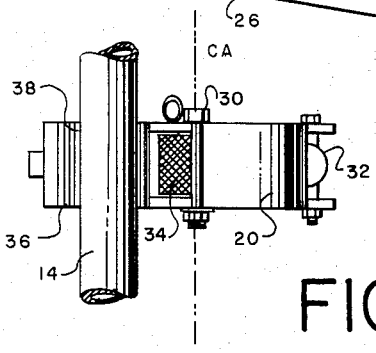
FIG. 5 is a top elevational view of the backup tong shown in FIG. 3 with parts broken away.
Figure 6:
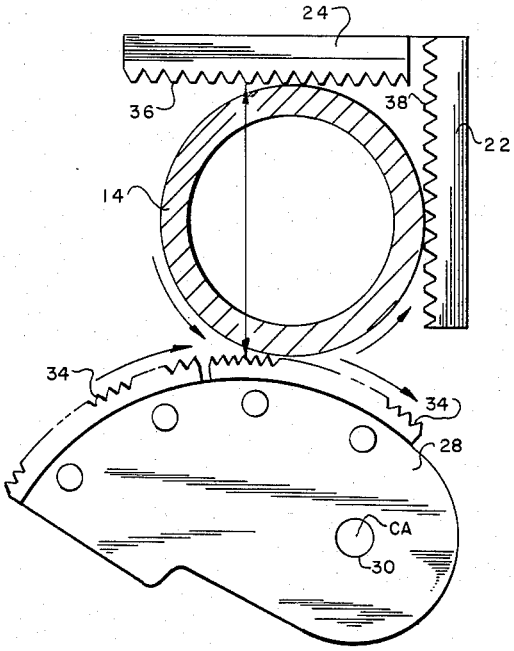
FIG. 6 is a detailed top plan view of the mouth of the backup tong shown in FIG. 3 with the moveable jaw engaged with the tubing.
Figure 7:
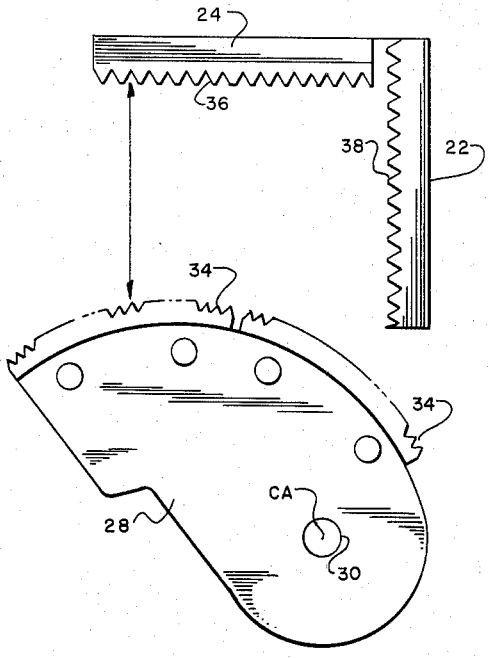
FIG. 7 is a detailed top plan view of the mouth of the backup tong shown in FIG. 3 with the moveable jaw in the closed position.

Referring to FIGS. 1, and 5, the backup tong 16 includes body 20 with flat faced backer 23 thereon. Fixed or body jaw 24 is rigidly attached to the body 20 adjacent and preferably perpendicular to the backer 22. The body 20 is preferably constructed of two parallel, spaced apart steel plates 26 forming a hollow cavity.

Moveable jaw 28 is journaled to the body 20 for movement about a cam axis "CA" by pivot bolt 30. The moveable jaw is opposite the fixed or body jaw 24 and adjacent the backer 22. The cam axis is parallel to the wall or side of tubing 14 aligned between the jaws 24 and 28.

Air cylinder 32 forms lever means connecting the body 20 and the moveable jaw 28 for moving the moveable jaw 28 about the cam axis. The purpose of the air cylinder 32 will be discussed in greater detail later.

The moveable jaw 28 has curved, gripping cam face 34 attached thereto. The body jaw 24 and the backer 22 have flat gripping fixed face 36 and backer face 38 attached thereto. The gripping faces 34, 36, and 38 are shown in the preferred embodiments as toothed plates bolted to the jaws and the backer. The faces 34, 36, and 38 are parallel to the cylindrical walls of tubing aligned with between the jaws. However, a gripping face is defined as any facing of the jaws and backer adapted to grip the cylindrical wall of tubing or other cylindrical goods. Those in the art will be familiar with the various gripping faces available to engage and form a frictional connection with cylindrical type goods. The gripping faces 34, 36, and 38 are preferably detachable from the jaws for easy interchangeability and replacement. The faces 34, 36, and 38 form a u-configured mouth for receiving the tubing to be gripped and held. The moveable jaw is moved away from the backer to open the mouth prior to aligning tubing between the jaws adjacent the backer.

Referring to FIGS. 3, 5, 6, and 7 the moveable jaw 28 and the cam face 34 thereon are specially shaped and disposed with respect to the cam axis. The curved cam face is eccentric to the cam axis such that as the moveable jaw 28 is moved by the air cylinder 32 toward the backer 22, the distance between the jaws 24 and 28 decreases.

In other words, the working area of the mouth changes as the moveable jaw 28 is moved about the cam axis. It will be understood that the distance between the fixed face 36 and the cam axis remains constant during movement of the moveable jaw 28. The moveable jaw 28 has ears 29 thereon by which the air cylinder 32 is attached.

Air cylinder control valve 40 is mounted on the bracket 18 for convenient access to the operator of the backup tongs. The valve 40 is connected by cylinder hoses 42 to the air cylinder 32, and by supply hose 44 to a source of compressed air. Those skilled in the art will be able to construct and use such simple air cylinder controls. Sources of compressed air are commonly available at well sites.

Figure 2:
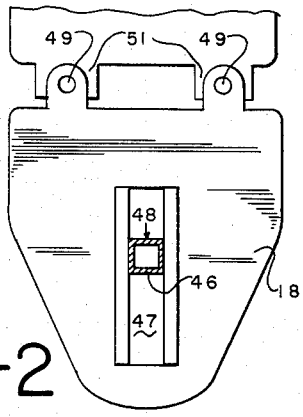
FIG. 2 is a front sectional view of a mounting bracket according to my invention taken substantially along line 2—2 of FIG. 3.
Figure 3:
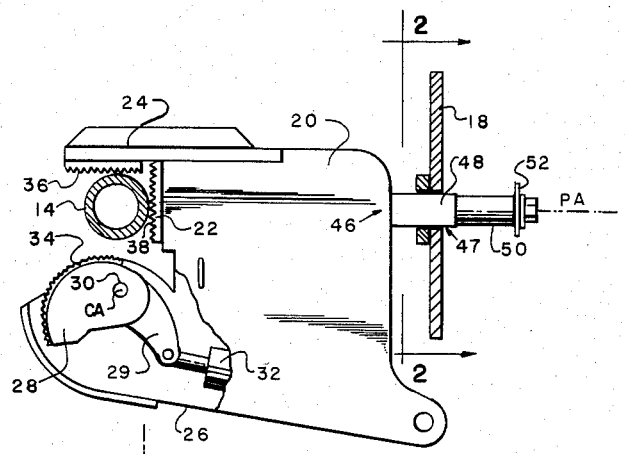
FIG. 3 is a top sectional view of the backup tongs taken substantially along line 3—3 of FIG. 1, with parts broken away, the moveable jaw in the withdrawn position, and the locking section positioned in the slot.
Figure 4:
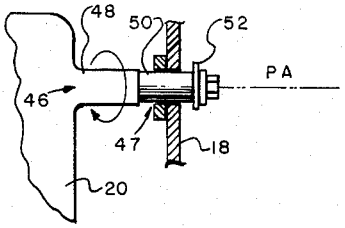
FIG. 4 is a partial top elevational view of the backup tong shown in FIG. 3 with the reversing section positioned in the slot.

Referring to FIGS. 2 through 4, the body 20 has post 46 extended therefrom aligned with the backer 22 and the mouth and perpendicular to the cam axis. The post 46 is slidably positioned in slot 47 in the bracket 18. The post 46 has a post axis "PA", locking section 48, a reversing section 50, and stop 52 bolted on the end thereof. The locking section 48 is proximate the body 20 opposite the stop 52 and is square in cross-section as shown in FIG. 2. The reversing section is between the locking section 48 and the stop 52, and is circular in cross-section. The diameter of the reversing section, and the width of the locking section, are slightly less than the width of the slot 47 in the bracket 18. Bracket bolts 49 connect the bracket 18 to tabs 51 on the spinning tongs 10.

The slot 47 is parallel to the cam axis and to the tubing, and allows the post 46 to slide freely to adjust the distance between the tongs during threading and unthreading operations. For example, the spinning tongs 10 and the backup tongs 16 each hold their respective lengths of tubing at fixed points therealong. However, as the tubing joint and string are threaded together during threading operations, the distance or length of tubing between the power tong and backup tong will decrease. The bracket and slidable connection of the backup tongs thereto permits automatic adjustment of the distance between the tongs 10 and 16.

As will be more fully described later, it is necessary to orient the body 20 so that the rotation will cause the backup tongs to grip and not release. Specifically prior to aligning the string of pipe within the mouth, the backup tongs are oriented so that the moveable jaw is positioned adjacent the tubing wall that will tend to move toward the backer 22. If not already properly aligned, the body 20 is rotated 180° about the pivot axis. This reversing operation is accomplished by pulling the square cross-sectioned locking section 48 out of the slot 47 to position the reversing section within the slot 47. The stop 52 keeps the post 46 in the slot 47. The tong body is then rotated 180°, and the locking section is pushed into the slot 47. It will be understood that the alignment of the joint and string of tubing 12 and 14 will keep the locking section 48 within the slot during operation of the spinning tongs 10.

The rotation of the joint of tubing threadably engaged with the string of tubing will induce rotation or movement of the string of tubing 14. The string of tubing is aligned between the jaws 24 and 28 within the mouth while orienting the backup tong body 20 so that induced rotational movement of the cylindrical tubing wall adjacent the moveable jaw 28 will be toward the backer 22. The air cylinder 32 is then extended to move the ear 29 and the moveable jaw 28 about the cam axis toward the backer 22. The cylindrical wall is contacted with the backer face, the fixed face, and the cam face.

The spinning tong 10 is operated, thereby inducing movement of the cylindrical wall adjacent the moveable jaw toward the backer 22. The frictional gripping action of the cam face 34 on the cylindrical wall will move the moveable jaw toward the backer along with the tubing wall. As the distance between the faces 34 and 36 decreases, greater pressure is exerted on the tubing walls, thereby increasing the gripping action of the faces 34 and 36. The moveable jaw 28 will move with the tubing wall toward the backer 22 until sufficient gripping action is applied to hold the string of tubing stationary. If additional gripping or holding capacity is required during operation, the movement of the moveable jaw responsive to additional movement of the tubing wall will increment the gripping action, thereby providing automatic adjustment of the gripping action as needed.

The function of the air cylinder 32 is to sufficiently engage the cam face 34 with the tubing wall 50 that the moveable jaw will be moved with tubing wall toward the backer 22. Therefore, substantial force from the air cylinder is not required. Indeed, the cam face could be manually engaged by a handle crank or the like connected to the moveable jaw. However, I prefer to employ an inexpensive air cylinder operated by readily available source of compressed air for the safety, convenience and efficiency of the operator.

The moveable jaw may be disengaged from the tubing by the reversing action common to some spinning power tongs, wherein the rotation of the length of tubing is reversed a partial turn to disengage the jaws of the power tongs from the length of tubing. Reversal of the direction of tubing rotation will move the moveable jaw away from the backer, and release the tubing. Alternatively, the air cylinder 32 may be retracted to move the moveable jaw 28 away from the backer.

Therefore, it may be seen that the automatically adjusted holding or gripping action of the backup tong according to my invention requires less power, and a less complicated and less expensive structure, with enhanced safety for the operator of such tools.

Figure 8:
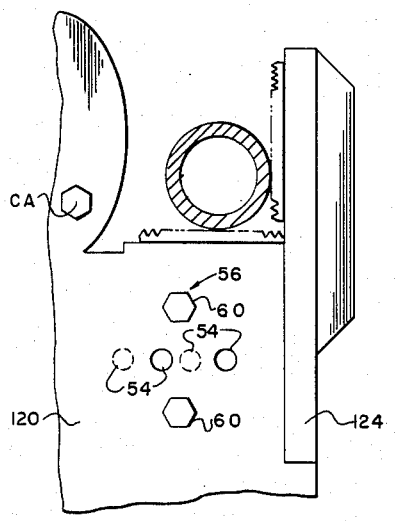
FIG. 8 is a top plan view of the backup tong shown in FIG. 3 with the body jaw in the large tubing diameter position.
Figure 9:
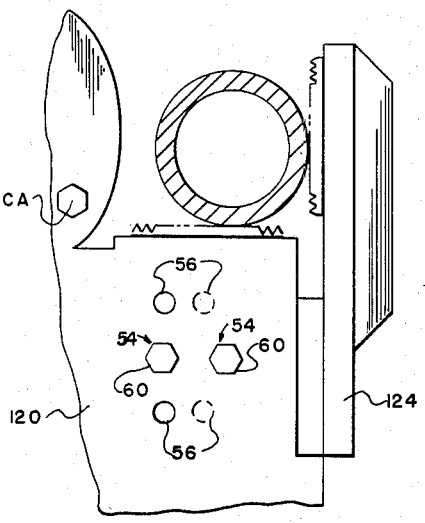
FIG. 9 is a top plan view of the backup tong shown in FIG. 3 with the body jaw in the small diameter tubing position.

FIGS. 8 and 9 show an embodiment of my invention with adjustment means for adjusting or changing the distance between the fixed face and the cam axis. Adjustment hole sets 54 and 56 in the body 120 and in body jaw 128 are offset so that when bolts 60 are inserted through hole set 54 and fastened to rigidly attach the jaw 128 to the body 120, the jaw 128 is separated from the cam axis a distance suitable for gripping and holding diameter tubing. When the bolts 60 are inserted through hole set 56, the fixed jaw 128 and the cam axis are separated a distance suitable for gripping and holding smaller diameter tubing. This adjustment feature enhances the utility and versatility of a backup tongs. It will be understood that other adjustments of the backup tongs, such as the position of the backers and body jaw, could be devised, and still be within the scope of my invention.

The embodiments shown and described above are only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

Counter balance spring 53, connecting the spinning tongs 10 and the body 20, keeps the backup tongs 16 aligned with the tubing 14. The spring 53 is disconnected during reversing rotation of the backup tongs 16.

As an aid to correlating the terms of the claims to the exemplary drawing, the following catalog of elements is provided:

| | | | |
|---|---|---|---|
| 10 | spinning tongs | 40 | air control valve |

-continued

| | | | |
|---|---|---|---|
| 12 | joint of tubing | 42 | cylinder hoses |
| 14 | string of tubing | 44 | supply hose |
| 16 | backup tongs | 46 | post |
| 18 | bracket | 47 | slot |
| 20 | backup tongs body | 48 | locking section |
| 22 | backer | 49 | bracket bolts |
| 24 | body jaw | 50 | reversing section |
| 26 | steel plates | 51 | tabs |
| 28 | moveable jaw | 52 | stop |
| 29 | ears | 53 | counterbalance spring |
| 30 | pivot bolt | 54 | hole set |
| 32 | air cylinder | 56 | hole set |
| 34 | cam face | 60 | bolts |
| 36 | fixed face | 120 | body |
| 38 | backer face | 124 | body jaw |

I claim as my invention:

1. In a tong assembly for threading and unthreading a joint of cylindrical goods into and from a string of cylindrical goods including:

a. spinning tongs for rotating the joint of cylindrical goods in threadable alignment with the string of cylindrical goods, and b. threadable engagement of the joint and string of cylindrical goods during rotation of the joint of cylindrical goods tending to induce rotational movement of the string of cylindrical goods, the improved backup tongs in combination with the above comprising:

c. a backup tong body connected to the spinning tongs, d. a moveable jaw journaled to the body for movement about a cam axis, e. a body jaw rigidly attached to the body opposite the moveable jaw, f. a backer on the body adjacent the moveable jaw and the body jaw, g. a cam face on the moveable jaw adapted to grip a wall of cylindrical goods aligned between the jaws, h. the cam face being curved convex to the wall, i. the cam axis being parallel to the wall, j. a fixed face on the body jaw adapted to grip the wall, k. the cam face being eccentric such that as the movable jaw is moved about the cam axis the distance between the cam face and the fixed face changes, l. lever means connected to the body and the movable jaw for moving the movable jaw about the cam axis, m. a bracket connected to the spinning tongs, n. a slot in the bracket parallel to the wall of the cylindrical goods, o. a post having an axis attached to the body with p. the backer aligned with the post axis, and q. the post being slidably positioned within the slot, r. the post having a locking section and a reversing section therealong, s. the reversing section having a circular cross-section with a diameter less than the width of the slot, t. the locking section having a square cross-section slightly less than the width of the slot, and u. a keeper at the end of the post larger than the width of the slot, v. the body being oriented to the cylindrical goods such that the induced rotation of the string of cylindrical goods will move an area of the wall adjacent the moveable jaw toward the backer, and w. the faces on each jaw being toothed plates attached thereto.

2. In a tong assembly for threading and unthreading a joint of cylindrical goods into and from a string of cylindrical goods including a. a spinning tong for rotating the joint of cylindrical goods in threadable alignment with the string of cylindrical goods, and b. threadable engagement of the joint and string of cylindrical goods during rotation of the joint of cylindrical goods tending to induce rotation of the string of cylindrical goods, the improved backup tongs in combination with the above comprising:

c. a backup tong body connected to the spinning tongs, d. a moveable jaw journaled to the body for movement about a cam axis, e. a body jaw attached to the body opposite the moveable jaw, f. a backer on the body adjacent the moveable jaw and the body jaw, g. a cam face on the moveable jaw adapted to grip a wall of cylindrical goods aligned between the jaws, h. the cam axis being parallel to the wall, i. a fixed face on the body jaw adapted to grip the wall, j. the cam face being eccentric such that as the moveable jaw is moved about the cam axis the distance between the cam face and the fixed face changes, k. lever means connected to the body and the moveable jaw for moving the moveable jaw about the cam axis, l. a baracket connected to the spinning tongs, m. a slot in the bracket parallel to the wall of the cylindrical goods, n. a post having an axis attached to the body with o. the backer aligned with the post axis, and p. the post being slidably positioned within the slot.

3. The invention as defined in claim 2 including all of the limitations a. through p. with the addition of the following limitations:

q. the post being rotatable within the slot, and r. locking means for preventing rotation of the post in the slot with the post being slidable within the slot.

4. The invention as defined in claim 2 including all of the limitations a. through p. with the addition of the following limitations:

q. the post having a locking section and a reversing section therealong, r. the reversing section having a circular cross-section, with a diameter less than the width of the slot, s. the locking section having a square cross-section slightly less than the width of the slot, and t. a keeper at the end of the post larger than the width of the slot.

5. In a tong assembly for threading and unthreading a joint of cylindrical goods into and from a string of cylindrical goods including a. spinning tongs for rotating the joint of cylindrical goods in threadable alignment with the string of cylindrical goods, and b. threadable engagement of the joint and string of cylindrical goods during rotation of the joint of cylindrical goods tending to induce rotation of the string of cylindrical goods, the improved backup tongs in combination with the above comprising:

c. a backup tong body,
d. jaws on the body for gripping the string of cylindrical goods,
e. the jaws forming a mouth,
f. a bracket connected to the spinning tong,
g. a slot in the bracket parallel to the wall of the cylindrical goods,
h. a post having an axis attached to the body with
i. the post axis aligned with the mouth, and
j. the post being slidably positioned within the slot.

6. The invention as defined in claim 5 including all of the limitations a. through j. with the addition of the following limitations:

k. the post being rotatable within the slot,
l. locking means for preventing rotation of the post in the slot with the post being slidable within the slot.

7. The invention as defined in claim 5 including all of the limitations a. through j. with the addition of the following limitations:

k. the post having a locking section and a reversing section therealong,
l. the reversing section having a circular cross-section, with a diameter less than the width of the slot,
m. the locking section having a square cross-section slightly less than the width of the slot, and
n. a keeper at the end of the post larger than the width of the slot.

* * * * *